US005198787A

United States Patent [19]

Sano et al.

[11] Patent Number: 5,198,787

[45] Date of Patent: Mar. 30, 1993

[54] WAVEGUIDE FOR DIVIDING AND COMBINING MICROWAVES

[75] Inventors: Eiichi Sano, Tokyo; Masahito Asa, Chiba; Masayuki Nakajima, Tokyo, all of Japan

[73] Assignee: Tokimec, Inc., Tokyo, Japan

[21] Appl. No.: 758,823

[22] Filed: Sep. 12, 1991

[30] Foreign Application Priority Data

Nov. 20, 1990 [JP] Japan ..... 2-315592

[51] Int. Cl.[5] ..... H01P 3/08; H01P 5/12

[52] U.S. Cl. ..... 333/128; 333/116; 333/137; 333/204

[58] Field of Search ..... 333/128, 116, 137, 161, 333/204, 35, 26, 202, 202 DB, 130, 134, 135, 136

[56] References Cited

U.S. PATENT DOCUMENTS 4,313,095 1/1982 Jean-Frederic ..... 333/128 X
4,739,519 4/1988 Findley ..... 333/128 X

FOREIGN PATENT DOCUMENTS 0046801 2/1988 Japan .
63-246002 10/1988 Japan .

OTHER PUBLICATIONS

Seymour B. Cohn, "A Class of Broadband Three-Port TEM-Mode Hybrids", IEEE Transactions of Microwave Theory and Techniques, vol. MTT-16, No. 2, Feb. 1968.

Reinut K. Hoffman et al, "Handbook of Microwave Integrated Circuits" Artech House, Inc. 1987.

*Primary Examiner*—Paul M. Dzierzynski
*Assistant Examiner*—Ali Neyzari
*Attorney, Agent, or Firm*—Lowe, Price, LeBlanc & Becker

[57] ABSTRACT

A waveguide having a pair of quarter-wavelength impedance transformers and adapted to divide and combine microwaves. The pair of quarter-wavelength impedance transformers includes two strip transmission lines connected together at one end, two ground conductors each located adjacent to and spaced from a respective one of said strip transmission lines, each said ground conductor serving as a ground potential at least mutually to the adjacent strip transmission line, and a dielectric substrate supporting thereon said strip transmission lines and said ground conductors. The two strip transmission lines may be connected to each other at numerous positions by resistors.

18 Claims, 6 Drawing Sheets

WAVEGUIDE FOR DIVIDING AND COMBINING MICROWAVES

BACKGROUND OF THE INVENTION

1. Field of the Invention

This invention relates to a microwave dividing and combining waveguide to be used in, for example, microwave communications.

2. Description of the Related Art

In microwave communications, various types of microwave dividing and combining waveguides are currently known.

FIG. 8 of the accompanying drawings shows a typical conventional waveguide. The conventional waveguide generally comprises a common port 90, a pair of distribution ports 91*a*, 91*b*, and a pair of quarter-wavelength impedance transformers 92*a*, 92*b* located between the distribution ports 91*a*, 91*b*.

The microwaves inputted from the common port 90 are divided by the two quarter-wavelength impedance transformers 92*a*, 92*b* and are outputted from the two distribution ports 91*a*, 91*b*. Reversely, the microwaves of the phase inputted from the two distribution ports 91*a*, 91*b* are combined by the two quarter-wavelength transformers 92*a*, 92*b* and are outputted from the common port 90.

This type of waveguide is disclosed in S. B. Cohn "A class of Broad Band Three-part TEM-Mode Hybrid" IEEE Transmission Microwave Theory Technology, MIT-16, No. 2 Feb. 1968), p.p. 110–116.

Recently a microstrip line has been developed to reduce the entire waveguide in size and widely utilized in microwave area.

In this microstrip line, as shown in FIG. 9, a strip conductor 96*a* is located on one surface of a dielectric substrate 95*a*, and a ground conductor 97*a* is located on the other surface of the dielectric substrate 95*a*.

Since linearly extending quarter-wavelength impedance transformers are used, the first-named conventional waveguide is difficult to reduce in size.

Also in the second-named waveguide in the form of a microstrip line, the width of the strip conductor 96*a* is determined from the dielectric constant and thickness of the dielectric substrate 95*a*; since the degree of freedom in designing is relatively small, there is a restriction in reducing the size of the waveguide.

In some of those types of conventional waveguides, resistors (isolation resistors) are provided to adjust the phase difference produced in the two impedance transformers. For example, as shown in FIG. 8, a plurality of isolation resistors 98 are located at a number of positions between the two strip conductors 92*a*, 92*b*. These isolation resistors 98 connect the two strip conductors 92*a*, 92*b* with each other at positions thereof to absorb the microwaves which are different in phase from each other.

However, if isolation resistors were used in the waveguide in the form of a microstrip line, a divided capacity would have occurred between the isolation resistors and the ground conductors of the microstrip line. Because of this divided capacity, the characteristic impedance of the individual impedance transformer will not reach 50Ω and will thus adversely affect the voltage standing wave ratio characteristics.

To this end, a solution has been proposed, as disclosed in Japanese Patent Laid-Open Publication No. Sho 63-246002, in which the capacitive component such as a condenser is located at a branch point of one end of the line serving as the impedance transformer. This construction, however, requires more circuit elements, making the line structure complex.

SUMMARY OF THE INVENTION

A first object of this invention is to provide a waveguide having an adequate degree of freedom in designing impedance transformers which is hence easy to reduce in size.

A second object of the invention is to provide a waveguide in which isolation resistors can be provided without causing any divided capacity, thus guaranteeing excellent voltage standing wave ratio characteristics.

The first object can be accomplished by a waveguide for dividing and combining microwaves, comprising a pair of quarter-wavelength impedance transformers, the quarter-wavelength impedance transformers including: two strip transmission lines connected together at one end; two ground conductors each located adjacent to and spaced from a respective one of the strip transmission lines, each the ground conductor serving as a ground potential at least mutually to the adjacent strip transmission line; and a dielectric substrate supporting thereon the strip transmission lines and the ground conductors.

The second object can be accomplished by a waveguide for dividing and combining microwaves, comprising a pair of quarter-wavelength impedance transformers, the quarter-wavelength impedance transformers including: two strip transmission lines connected together at one end; two ground conductors each located adjacent to and spaced from a respective one of the strip transmission lines, each the ground conductor serving as a ground potential at least mutually to the adjacent strip transmission line; a dielectric substrate supporting thereon the strip transmission lines and the ground conductors; and a plurality of resistors connecting the two strip transmission lines with each other at a plurality of positions.

In each of these arrangements, the two strip transmission lines may be located in a predetermined region on the dielectric substrate, with portions other than the connected ends being spaced from each other. Each the strip transmission line may be a conductive strip having a path longer than the distance between its opposite ends. At least a part of each the strip transmission line may be a meandering conductive strip.

The two strip transmission lines may be located on the dielectric substrate in mirror-image symmetry.

The ground conductors corresponding to the two strip transmission lines may be located outside the predetermined region on the dielectric substrate. Each the ground conductor may define a substantially half-plane.

The resistors may be located one at each position where the two meandering conductive strips are adjacent to each other. Each resistor may have a resistance progressively increasing from one end, where the two strip transmission lines are connected to each other, to the other end.

With the arrangement of this invention, since the two strip transmission lines and the two ground conductors are located on a common surface of the dielectric substrate, low-impedance lines can be each in the form of a narrow conductive strip. Therefore an adequate degree of freedom in designing the impedance transformers can be realized so that the strip transmission lines can be curved into a meandering form. As a result, it is possible to locate long impedance transformers on a relatively small substrate so that the waveguide can be reduced in size.

According to this invention, both the two strip transmission lines and the two ground conductors are located on a common surface of the dielectric substrate, namely, no ground conductors are located on the other surface of the dielectric substrate, in which case it is possible to prevent any occurrence of divided capacitance if the waveguide is provided with isolation resistors. Therefore the waveguide is free of any lag of impedance characteristics due to this divided capacity, guaranteeing good voltage standing wave ratio characteristics.

In this waveguide, when a microwave is inputted to a common connected one end of the two strip transmission lines, divided microwaves are outputted from the respective other ends, which are unconnected, of the two strip transmission lines. Reversely, when microwaves are inputted from the respective unconnected ends of the two strip transmission lines, a combined microwave is obtained from the common connected end of the two strip transmission lines.

The larger the area of the isolation resistors, the more the divided capacity will become influential. Therefore this invention is particularly useful when applied to a large-power waveguide that requires a large area to be occupied by isolation resistors.

DETAILED DESCRIPTION OF THE PREFERRED EMBODIMENTS

In the specification, the terms "right", "left", "upper" and "lower" mean respective particular directions in the accompanying drawings.

Figure 1:
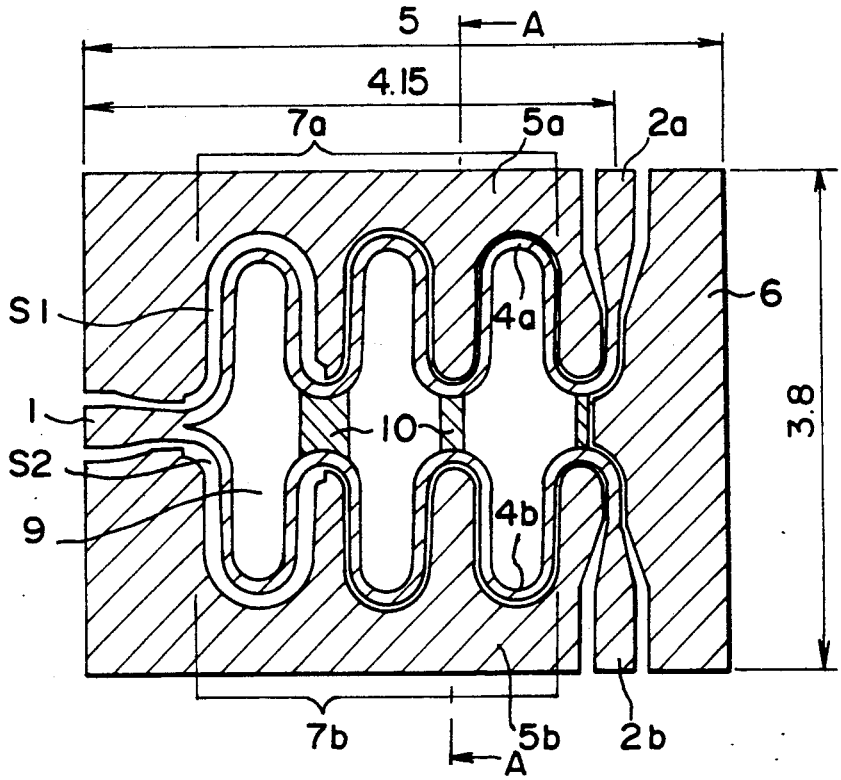
FIG. 1 is a plan view showing a waveguide embodying this invention.
Figure 2:
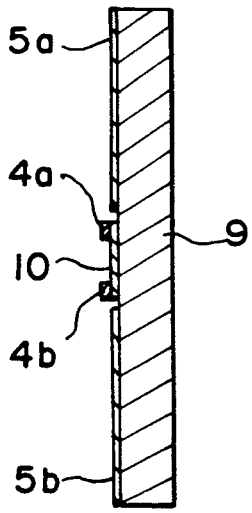
FIG. 2 is a cross-sectional view taken along line A—A of FIG. 1.

The principles of this invention are particularly useful when applied to a microwave dividing and combining waveguide such as is shown in FIGS. 1 and 2.

Figure 7:
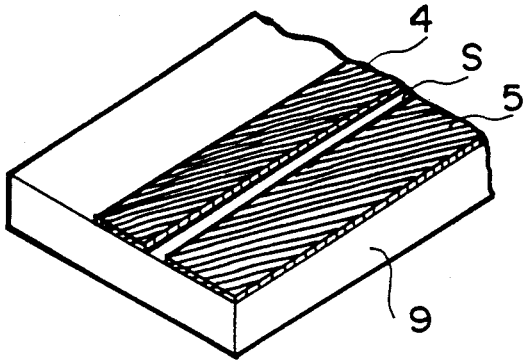
FIG. 7 is a perspective view showing the basic structure of a non-symmetrical double-strip coplanar waveguide.
Figure 9:
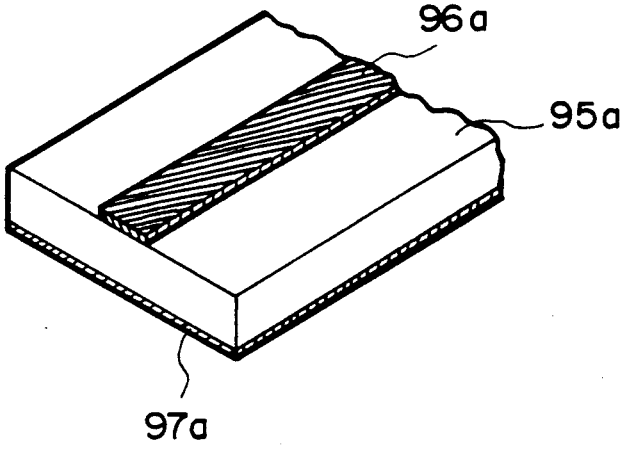
FIG.9 PRIOR ART
FIG. 9 is a perspective view showing the basic structure of a conventional microstrip line.

This waveguide comprises a non-symmetrical double-strip coplanar waveguide, whose basic structure is shown in FIG. 7.

The non-symmetrical double-strip coplanar waveguide, unlike an ordinary coplanar waveguide, comprises a dielectric substrate 9, a strip transmission line in the form of a strip of conductor 4 located on one surface of the dielectric substrate 9, and a ground conductor 5 located on the same surface of the dielectric substrate 9 along one edge of the strip conductor 4 with a space S therebetween. It is unnecessary for the width of the strip conductor 4 to equal that of the ground conductor 5.

Generally, double-strip coplanar waveguides are disclosed in R. K. Hoffman, "handbook of Microwave Integrated Circuits", Artech House.

In the waveguide, as shown in FIGS. 1 and 2, a common port 1, a pair of distribution ports 2*a*, 2*b*, a pair of strip conductors 4*a*, 4*b*, a pair of first ground conductors 5*a*, 5*b* and a second conductor 6 are formed on one surface of the dielectric substrate 9 by sputtering gold. Between the distribution ports 2*a*, 2*b*, isolation resistors 10 are formed in a predetermined pattern by sputtering tantalum nitride.

The common port 1 is located the left end of the dielectric substrate 9, and to this common port 1 a microwave to be divided by a pair of quarter-wavelength impedance transformers 7*a*, 7*b* is inputted. Reversely, from this common port 1 a microwave combined by the two quarter-wavelength impedance transformers 7*a*, 7*b* is outputted. The thus divided microwaves are outputted from the distribution ports 2*a*, 2*b* located at the upper right end and the lower right end, respectively, of the dielectric substrate 9. Reversely, microwaves to be combined by the two quarter-wavelength impedance transformers 7*a*, 7*b* are inputted from the two distribution ports 2*a*, 2*b*.

Each quarter-wavelength impedance transformer 7*a*, 7*b* includes a strip transmission line in the form of strip conductors 4*a*, 4*b* located between the common port 1 and the distribution port 2, ground conductors 5*a*, 5*b* to be a relative ground potential to the respective adjacent strip conductors 4*a*, 4*b*, the isolation resistors 10, and the dielectric substrate 9, having the functions of dividing and combining microwaves. In this embodiment, division takes place uniformly; however, this invention should be no means be limited to such an example.

The two strip conductors 4*a*, 4*b* are joined at their one ends with the common port 1 in the horizontal center line of the dielectric substrate 9. The portions, of the strip conductors 4*a*, 4*b*, other than the connected ends are located in a predetermined region on the dielectric substrate 9 and are spaced apart from each other. One strip conductor 4*a* extends rightwardly meandering in the upper half region of the surface of the dielectric substrate 9 and is connected to the distribution port 2*a*. Likewise the other strip conductor 4*b* extends rightwardly meandering in the lower half region of the surface of the dielectric substrate 9 and is connected to the distribution port 2*b*. The winding path of meander of each strip conductor 4*a*, 4*b* is set up in such a manner that a single section of the displacement is equal to a quarter-wave length.

The isolation resistors 10, three in total, are located at respective positions where the two strip conductors 4*a*, 4*b* are adjacent to each other, namely, one between each pair of confronting turnovers of the two winding paths, i.e., one at every quarter wavelength.

The space S1 between the strip conductor 4*a* and the first ground conductor 5*a* and the space S2 between the strip conductor 4*b* and the first ground conductor 5*b* are respectively convergent toward the respective distribution ports 2*a*, 2*b*. The isolation resistors 10 are different in size, becoming smaller from one another toward the distribution ports 2a, 2b; this is, the farther the resistor 10 is located from the common port 1, the higher the resistance value.

The curvature, shape and line width of the strip conductors 4a, 4b as well as the shape, number and size of the isolation resistors 10 should by no means be limited to those of the illustrated examples and may be changed depending on the purpose, use, etc. of the individual elements.

Each first ground conductor 5a, 5b is located outside the region where the strip conductor 4a, 4b is located on the dielectric substrate 9, electrically defining a substantially half-plane. The half-plane may be such that the first ground conductor 5a, 5b extends from the portion adjacent to the corresponding to the strip conductor 4a, 4b to an infinite point and is large enough to treat electrically.

Specifically, as shown in FIG. 1, the first ground conductor 5a is located in the region on the upperside of the strip conductor 4a, and the first ground conductor 5b is located in the region on the lowerside of the strip conductor 4b. Thus there is no ground conductor between the two strip conductors 4a, 4b.

The second ground conductor 6 is located in the region to the right of the distribution ports 2a, 2b.

The dielectric substrate 9 comprises alumina and should by no means be limited to this specific example.

The distance between the common port 1 and the distribution ports 2a, 2b is about 4 mm; the strip conductors 4a, 4b meander and hence have a path length which is longer than this distance.

When a microwave is inputted from the common port 1, this microwave is equally divided by the two quarter-wavelength impedance transformers 7a, 7b, and the divided microwaves are outputted from the respective distribution ports 2a, 2b.

Reversely, when microwaves are inputted from the two distribution ports 2a, 2b, these microwaves are combined by the two quarter-wavelength impedance transformers 7a, 7b and the combined microwave is outputted from the common port 1.

FIGS. 3A, 3B, 4A and 4B show the distribution characteristics and the synthesis characteristics measured when a microwave was inputted from the common port 1.

Figure 3A:
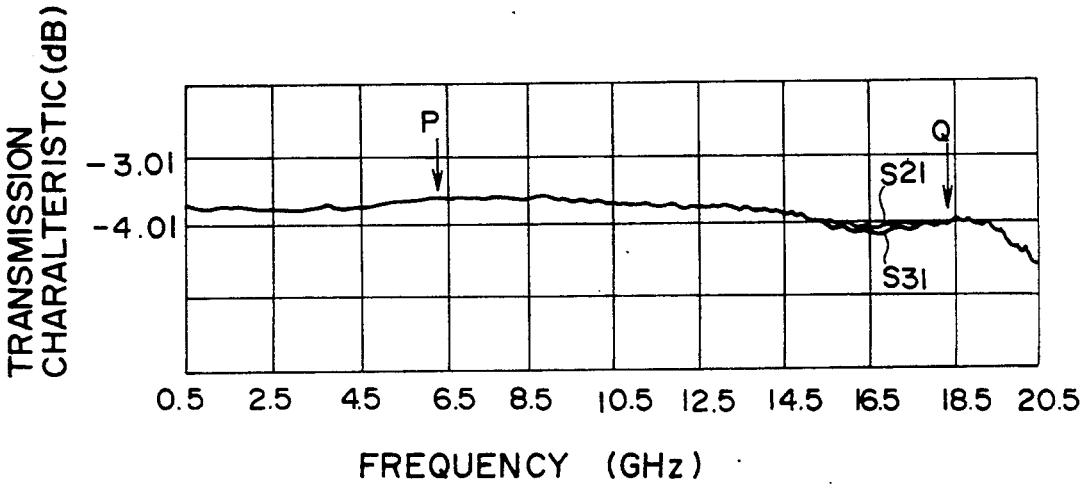
FIGS. 3A and 3B are graphs showing permeation characteristics and reflection characteristics, respectively.
Figure 3B:
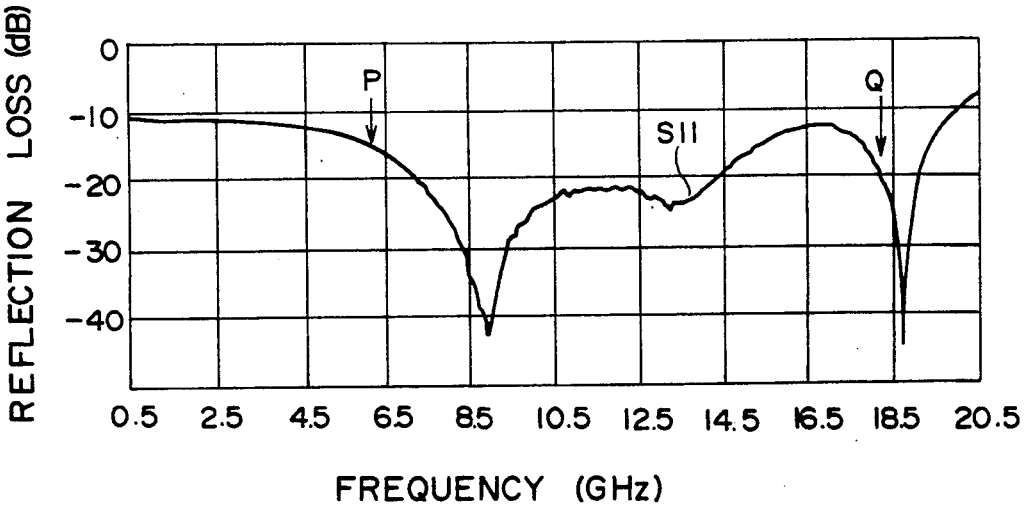

Specifically, FIGS. 3A and 3B show microwave permeation characteristics and microwave reflection characteristics, respectively, the x axis representing the frequency of an inputted microwave.

As shown in FIG. 3A, the permeation characteristics S21 from the common port 1 to the distribution port 2a was substantially identical with the permeation characteristics S31 from the common port 1 to the distribution port 2b along the entire range of measured frequencies (6 GHz to 20.5 GHz), from which it is noted that the microwave was uniformly divided. Regarding the permeation characteristics, attenuation was −3.7 dB at 6 GHz (indicated by P in FIG. 3A) and transmission loss was 0.7 dB. At 18 GHz (indicated by Q in FIG. 3A), attenuation was −3.9 dB and transmission loss was −1.0 dB, which are adequately practical values. In the range of 6 GHz to 18 GHz, these values were substantially constant.

As shown in FIG. 3B, when a microwave was inputted from the common port 1, the reflection characteristic S11 was over −13 dB, which is adequately small, in the range of 6 GHz to 18 GHz.

Figure 4A:
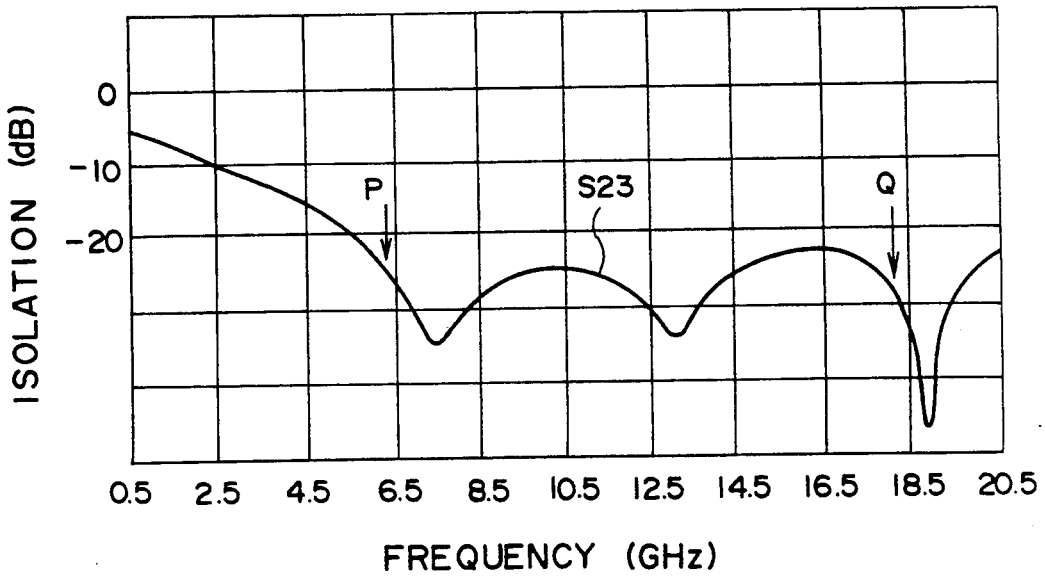
FIGS. 4A and 4B are graphs showing isolation characteristics and reflection characteristics, respectively, at distribution ports.
Figure 4B:
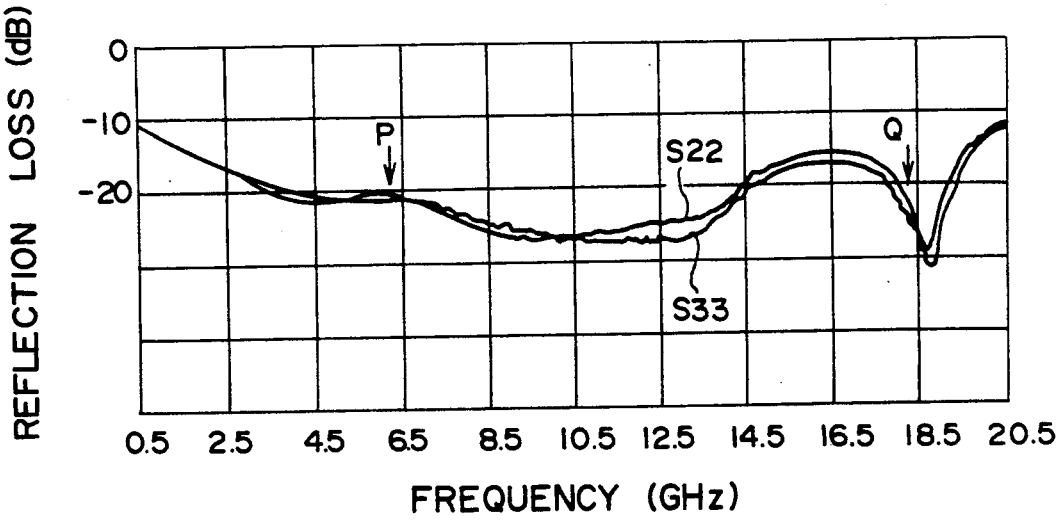

FIGS. 4A and 4B show the isolation characteristics and the reflection loss measured when microwaves were inputted from the distribution ports 2a, 2b.

The isolation characteristic S23, which shows the amount of leaked microwave from the distribution port 2a to the distribution port 2b, was below −21 dB over the entire range of 6 GHz (indicated by P) to 18 GHz (indicated by Q), thus causing a remarkable isolation effect.

FIG. 4B shows the reflection characteristics measured when microwaves were inputted from the distribution ports 2a, 2b, the x axis representing frequencies.

As shown in FIG. 4B, the reflection characteristic S22 at the distribution port 2a was substantially identical with the reflection characteristic S33 at the distribution port 2b. Over the entire range of 6 GHz to 18 GHz, reflection loss was below −15 dB so that microwaves can be combined, thus causing an adequate reflection characteristics.

With the waveguide of this embodiment, since a nonsymmetrical double-strip coplanar waveguide is used, it is possible to reduce the line width of the strip conductors, thus minimizing the area of the surface of the dielectric substrate occupied by the strip transmission lines. Also, by reducing the line width of the strip conductors, the meandering portion of the strip conductors can be formed without deteriorating the voltage standing wave ratio characteristics. Therefore, it is possible to increase the degree of freedom in designing the line length, line width, line curvature, etc. of the individual strip conductor.

Further, since the ground conductors are located outside the region in which the strip conductors are located, it is possible to locate the isolation resistors at optional positions in the region between the two strip conductors. There is no ground conductor on the lower surface of the dielectric substrate; that is, there exists no conductor on the lower surface of the dielectric substrate at positions where the isolation resistors are located, thus causing virtually no occurrence of divided capacitance in the isolation resistors. As a result, it is possible to obtain the target value, e.g. 50Ω, of the impedance transformer, guaranteeing a good voltage standing wave ratio characteristics.

According to this embodiment, it is possible to increase the line length to be formed within a unit area, without deteriorating the voltage standing wave ratio characteristics, thus realizing a physically smaller waveguide.

Practically, in order to construct a waveguide the same in performance as the illustrated embodiment by using microstrip lines, the distance between the common port and the distribution ports should be about 11 mm. Whereas in this embodiment it requires only less than half of that, i.e. about 4 mm.

Figure 5:
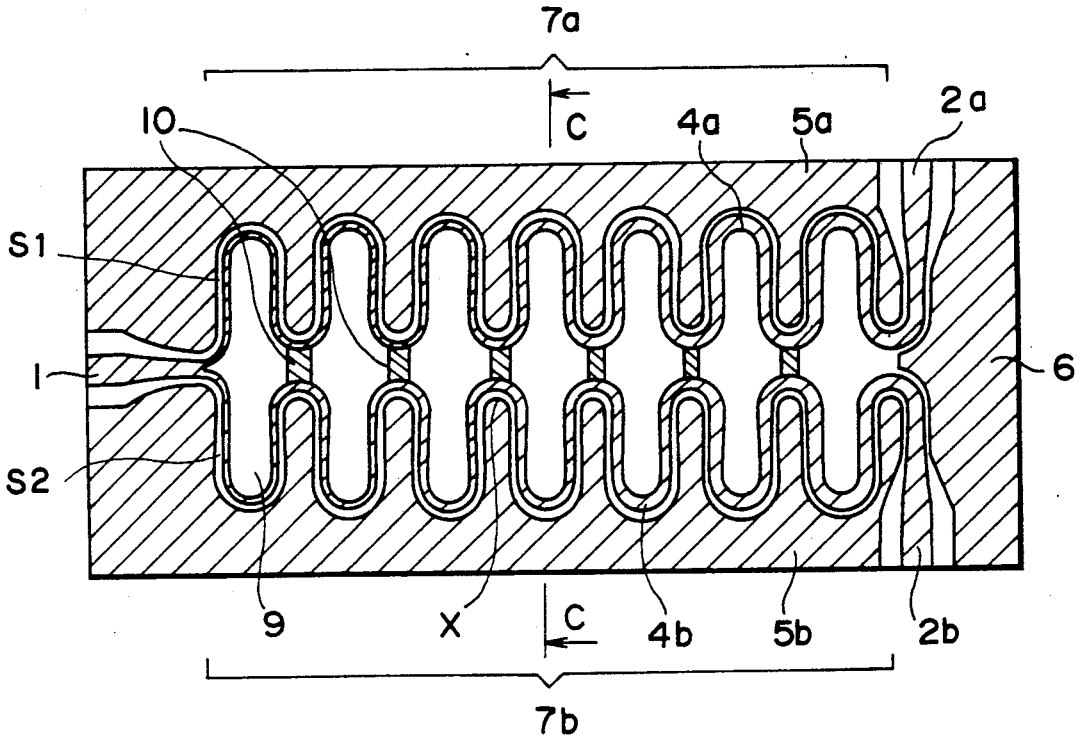
FIG. 5 is a plan view showing a modified waveguide according to another embodiment of the invention.
Figure 6:
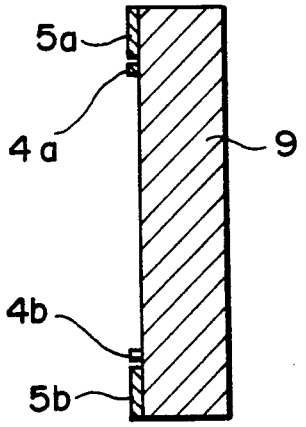
FIG. 6 is a cross-sectional view taken along line C—C of FIG. 5.
Figure 8:
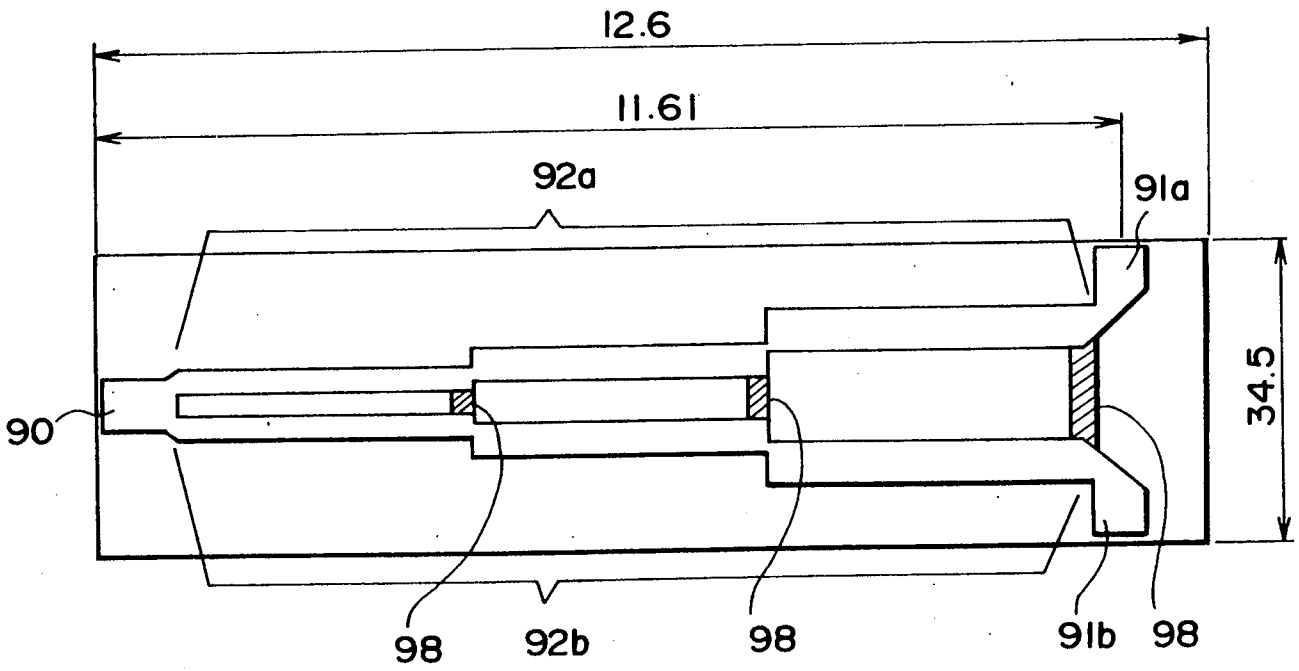
FIG.8 PRIOR ART
FIG. 8 is a diagram showing a conventional waveguide.

FIGS. 5 and 6 show a modified waveguide according to the second embodiment of this invention.

The waveguide of the second embodiment is identical in basic structure with that of the first embodiment; therefore any repetition of description is avoided here for clarity.

The two strip conductors 4a, 4b are connected to each other by a total of six isolation resistors 10 at respective positions where the two strip conductors 4a, 4b are adjacent to each other, namely, one resistor between each pair of confronting turnovers of the two winding paths, i.e., one at every quarter wavelength.

The space S1 between the strip conductor 4a and the first ground conductor 5a and the space S2 between the strip conductor 4b and the first ground conductor 5b are respectively convergent toward the respective distribution ports 2a, 2b, and each strip conductor 4a, 4b has a varying line width increasing progressively toward the respective distribution port 2a, 2b.

In operation, when a microwave is inputted from the common port 1, this microwave is uniformly divided by the two quarter-wavelength impedance transformers 7a, 7b and the divided microwaves are outputted from the respective distribution ports 2a, 2b.

Reversely, when microwaves are inputted respectively from the two distribution ports 2a, 2b, these microwaves are combined by the two quarter-wavelength impedance transformers 7a, 7b and the combined microwave is outputted from the common port 1.

The waveguide of this embodiment also has practically adequate characteristics.

This waveguide can produce the same result as that of the first embodiment. It is possible to increase the line length to be formed in a unit area, thus realizing a physically smaller waveguide.

What is claimed is:

1. A waveguide for dividing and combining microwaves, comprising a first port, a pair of second ports and a pair of quarter-wavelength impedance transformers, each of said quarter-wavelength impedance transformers having the first port as its first terminal and one of the second ports as its second terminal and including:

(a) a strip transmission line connected between the first terminal and the second terminal and having a width progressively increasing from the first terminal toward the second terminal;

(b) a ground conductor located adjacent and spaced from said strip transmission line, said ground conductor serving as a grounded potential mutually to the adjacent strip transmission line; and (c) a dielectric substrate supporting thereon said strip transmission line and said ground conductor.

2. A waveguide according to claim 1, wherein said two strip transmission lines are located in a predetermined region on said dielectric substrate, with portions other than the connected ends being spaced from each other, and said ground conductors are located outside said predetermined region on said dielectric substrate.

3. A waveguide according to claim 2, wherein each said ground conductor defines a substantially half-plane.

4. A waveguide according to claim 3, wherein each said strip transmission line is a conductive strip having a path length longer than the distance between its opposite ends.

5. A waveguide according to claim 2, wherein at least a part of each said strip transmission line is a meandering conductive strip.

6. A waveguide according to claim 4, wherein at least a part of each said strip transmission line is a meandering conductive strip.

7. A waveguide according to claim 1, further comprising a plurality of resistors connecting said two strip transmission lines with each other at a plurality of positions.

8. A waveguide according to claim 7, wherein said two strip transmission lines are located in a predetermined region on said dielectric substrate, with portions other than the connected ends being spaced from each other, and said ground conductors are located outside said predetermined region on said dielectric substrate.

9. A waveguide according to claim 8, wherein each said ground conductor defines a substantially half-plane.

10. A waveguide according to claim 9, wherein each said strip transmission line is a conductive strip having a path length longer than the distance between its opposite ends.

11. A waveguide according to claim 8, wherein at least a part of each said strip transmission line is a meandering conductive strip.

12. A waveguide according to claim 9, wherein at least a part of each said strip transmission line is a meandering conductive strip.

13. A waveguide according to claim 11, wherein said resistors are located one at each of positions where the two meandering conductive strips are adjacent to each other.

14. A waveguide according to claim 13, wherein each of said resistors has a resistance progressively increasing from one end, where said top strip transmission lines are connected to each other, towards the other end.

15. A waveguide according to claim 12, wherein said resistors are located one at each of the positions where the two meandering conductive strips are adjacent to each other.

16. A waveguide accor ling to claim 15, wherein each of said resistors has a resistance progressively increasing from one end, where said two strip transmission lines are connected to each other, towards the other end.

17. A microwave circuit comprising a dielectric substrate, a first port, a pair of second ports and at least a pair of quarter-wavelength impedance transformers formed on a surface of said substrate, each of said quarter-wavelength impedance transformers having the first port as its first terminal and one of the second ports as its second terminal and including:

a strip transmission line connected between the first terminal and the second terminal and having constant width, a grounded conductor adjacent said strip transmission line, each said strip transmission line being adjacent only one grounded conductor, said strip transmission line being separated from the grounded conductor by a space progressively decreasing from the first terminal toward the second terminal.

18. A microwave circuit according to claim 17, wherein at least a part of said conductive strip is a meandering conductive strip.

* * * * *